US005122157A

United States Patent [19]

Dubreux et al.

[11] Patent Number: 5,122,157

[45] Date of Patent: * Jun. 16, 1992

[54] PROCESS OF BLEACHING LAUNDRY

[75] Inventors: Bernard Dubreux, Franceheville le Bas; Yann Dugenet, Issy les Moulineaux, both of France

[73] Assignee: Atochem, Puteaux, France

[ * ] Notice: The portion of the term of this patent subsequent to Oct. 13, 2004 has been disclaimed.

[21] Appl. No.: 630,334

[22] Filed: Dec. 17, 1990

Related U.S. Application Data

[63] Continuation of Ser. No. 24,613, Mar. 4, 1987, abandoned, which is a continuation-in-part of Ser. No. 799,027, Apr. 18, 1985, Pat. No. 4,699,623.

[30] Foreign Application Priority Data

Nov. 21, 1984 [FR] France ..... 84 17940
Mar. 28, 1986 [FR] France ..... 86 04736

[51] Int. Cl.[5] ..... D06L 3/02; D06L 3/16; C11D 7/54

[52] U.S. Cl. ..... 8/111; 28/107; 252/186.27; 252/186.28; 252/186.30; 252/186.37; 252/186.38; 252/186.41; 252/186.42

[58] Field of Search ..... 8/107, 111; 252/186.27, 252/186.28, 186.30, 186.37, 186.38, 186.41, 186.42

[56] References Cited

U.S. PATENT DOCUMENTS

| | | | |
|---|---|---|---|
| 3,210,284 | 10/1965 | Duvall | 252/80 |
| 3,437,599 | 4/1969 | Helmick et al. | 252/186.28 |
| 4,620,935 | 11/1986 | Baxter et al. | 8/107 |
| 4,623,357 | 11/1986 | Urban | 8/107 |
| 4,631,141 | 12/1986 | Baxter | 8/111 |
| 4,699,623 | 10/1987 | Dubreux et al. | 8/111 |
| 4,810,408 | 3/1989 | Dubreux et al. | 252/99 |
| 4,810,410 | 3/1989 | Diakun et al. | 252/102 |

*Primary Examiner*—A. Lionel Clingman
*Assistant Examiner*—Linda D. Skaling

[57] ABSTRACT

A process for bleaching domestic laundry in a household wash cycle, comprising prewashing the laundry in an alkaline bath with a pH value between 9 and 13 and at a temperature between about 40° C. and 70° C. in the presence of at least one peroxide bleaching agent and an uncomplexed barium, said barium being present in an amount between about $0.5\times10^{-3}$ and $250\times10^{-3}$ gram-atoms per kg of bath.

9 Claims, No Drawings

PROCESS OF BLEACHING LAUNDRY

REFERENCE TO RELATED APPLICATION

This application is a continuation, of application Ser. No. 024,613, field Mar. 11, 1987, now abandoned.

BACKGROUND OF THE INVENTION

The present invention pertains to the bleaching of household linen in a household wash cycle, comprising a prewash, followed by rinsing and washing operations.

It constitutes, more particularly, an improvement of the process described in U.S. patent application Ser. No. 799,027 in the sense that a new means is placed at the industry's disposal to achieve and surpass the intended bleaching effect.

The persalts, particularly sodium perborate, are the bleaching agents most widely used in cleaning, but they are also rather uneconomical carriers of active oxygen.

Moreover, at temperatures below ca. 70° C., these persalts or peroxyhydrates have sufficient activity only in the presence of so-called activating compounds, which considerably increase the cost of the compositions with bleaching action which contain them with or without detergents.

The process proposed in the above-referenced patent application permits the bleaching effect of such compositions to be improved.

In a household wash cycle comprising prewash in an alkaline bath with pH values between 9 and 13 at a temperature at most equaling 70° C., in the presence of at least one peroxide bleaching agent, it consists of carrying out the said prewash at a temperature between 40° C. and 70° C. in the presence of uncomplexed calcium taken in a quantity between 0.002 and 1 wt.% relative to the weight of the bath and the subsequent conventional rinse and wash operations of the known cycles.

The presence of calcium in the prewash bath can be ensured, e.g., by dissolving calcium oxide (CaO) or calcium hydroxide ($Ca(OH)_2$) in said prewash bath.

It is preferably ensured by adding to the prewash bath a calcium salt whose anion is inert with respect to the peroxide bleaching agent and whose dissociation constant is higher than 0.01.

For example, calcium chloride corresponds to this definition particularly well.

The preferred quantity of uncomplexed calcium is between 0.005% and 0.1% of the bath weight.

The peroxide bleaching agent present in the prewash bath is selected from among those commonly used in the bleaching baths for bleachable stains of household linen or in the so-called complete detergents which assume the same function, such as, e.g., hydrogen peroxide, sodium perborate, sodium percarbonate and urea peroxyhydrate. The active oxygen concentration resulting from the presence of such bleaching agents is generally between 0.004% and 0.03% of the weight of the bath.

The prewash bath may contain complexing agents of metal ions, especially alkaline-earth metals, but doing so in such a quantity that the quantity of uncomplexed calcium characterizing the said bath is respect in the bath.

The prewash bath may also contain, in nature and in quantity, the detergent products and the other ingredients usually present in a standard prewash starting a known household wash cycle. Finally, the prewash bath may also be formed by a mixture; in an aqueous medium, of the alkaline agent, the peroxide bleaching agent and the salt selected as the source of calcium.

In such a case, the prewash bath preferably contains the calcium and the alkaline agent at a ratio that would correspond to the formation of $Ca(OH)_2$.

The preferred alkaline agent is sodium hydroxide (NaOH), but the product which is used as the calcium source may also be the sole or partial source of the alkalinity of the bath if it is selected from among calcium oxide or calcium hydroxide.

The preferred pH range is 10.5-12.5.

The temperature range of 40° C.-70° C. is preferred for carrying out the present invention, because it only leads to an insignificant improvement in bleaching effect at temperatures lower than 40° C., while the energy cost soon becomes prohibitive at temperatures above 70° C.

The duration of the prewash is basically dependent on the other conditions selected for this operation. For this invention, it is analogous to that of a classical prewash, i e., it is generally shorter than one hour.

SUMMARY OF THE INVENTION

It has now been found that what was described above with respect to calcium could also be advantageously extended to barium, at concentrations between $0.5\times10^{-3}$ and $25\times10^{-3}$ gram-atoms.

Briefly stated, the present invention comprises a process for bleaching domestic laundry in a household wash cycle, comprising prewashing the laundry in an alkaline bath with a pH value between 9 and 13 and at a temperature between about 40° C. and 70° C. in the presence of at least one peroxide bleaching agent and an uncomplexed barium, said barium being present in an amount between about $0.5\times10^{-3}$ and $250\times10^{-3}$ gram-atoms per kg of bath.

DETAILED DESCRIPTION

The disclosure of parent U.S. patent application Ser. No. 799,027 is incorporated herein in its entirety.

The barium can be introduced into the prewash bath by, for example, dissolving therein a barium salt such as barium chloride, barium oxide, or barium hydroxide.

It is preferably introduced by adding to the prewash bath a barium salt whose anion is inert with respect to the peroxide bleaching agent and whose dissociation constant is greater than 0.01. Barium chloride, for example, meets this requirement particularly well.

The preferred quantity of uncomplexed barium is between $0.5\times10^{-3}$ and $250\times10^{-3}$ gram-atoms per kg of the bath; preferably between about $1.25\times10^{-3}$ to $25\times10^{-3}$.

The peroxide bleaching agent present in the prewash bath is selected from those commonly employed in bleaching baths for bleachable stains on domestic laundry or from the so-called complete detergent compositions which perform this same function, such as hydrogen peroxide, sodium perborate, sodium percarbonate or urea peroxyhydrate. The active oxygen concentration resulting from the presence of such bleaching agents is generally between 0.004% and 0.03% of the weight of the bath.

The prewash bath can contain agents which complex metal ions, in particular ions of the alkaline earth metals, but in quantities such that the quantity of uncomplexed barium in the bath, which characterizes said bath, is maintained.

The prewash bath can also contain, in nature and in quantity, the detergent products and other ingredients usually present in a conventional prewash which begins a known domestic washing cycle.

Finally, the prewash can consist solely of a mixture, in an aqueous environment, of the alkaline agent, the peroxide bleaching agent and the salt selected to be the source of barium.

In a similar case, the prewash bath preferably contains barium and the alkaline agent in the ratio which would correspond to the formation of $Ba(OH)_2$.

The preferred alkaline agent is sodium hydroxide, but the product which is the barium source can be the cause, totally or partly, of the alkalinity of the bath when it is selected from barium oxide or barium hydroxide.

The preferred pH range is between 10.5 and 12.5.

The temperature range between 40° C. and 70° C. is preferred for implementation of the invention, since at temperatures below 40° C., the invention only results in an insignificant improvement in bleaching effect, and at temperatures above 70° C., it leads to a rapidly prohibitive expenditure of energy.

The duration of the prewash largely depends on the other conditions under which this operation is effected. In the invention, it is analogous to that of a conventional prewash and is thus generally less than one hour.

The process according to the present invention will be further described by the following examples, which are set forth for purposes of illustration only.

In these examples:

(i) the term "detergent" designates the standard EMPA detergent powder of the following composition (on weight basis):

| | |
|---|---|
| $Na_2SiO_3$ | 5.34% |
| $Na_2SO_4$ | 7.25% |
| $Na_2CO_3$ | 2.65% |
| $Na_2HPO_4$ | 0.96% |
| $Na_2P_2O_7$ | 3.99% |
| $Na_5P_3O_{10}$ | 30.41% |
| $NaPO_3$ | 11.92% |
| $H_2O$ | 18.90% |
| surface-active agents | 14.00% |
| washing bluing, and the like | 4.58%; |

(ii) the prewash and wash operations are carried out in an AHIBA G VI B water bath;

(iii) the weight ratio of the bath to the material to be bleached equals ca. 20;

(iv) the material to be bleached is a standard EMPA fabric with wine or tea stain;

(v) The bleaching effect is determined as the difference between the whiteness indices after and before the application of the wash cycle or as the change in whiteness as the percentage of a maximum white of 100 according to the formula:

$$\text{bleaching effect} = \frac{\text{change in whiteness}}{100 - \text{initial whiteness}} \times 100,$$

with the measurements carried out by means of an ELREPHO spectrophotometer, using a No. 6 filter from the firm of CARL ZEISS;

(vi) the household wash cycles, whose prewash and wash stages are defined in the examples by their temperature level, comprise, in each of these stages, a hold time of 30 minutes and a time of 20 minutes, during which the temperature level is reached from an ambient temperature of ca. 20° C.; and (vii) after the prewash, just as after the wash, the fabric treated is separated from the bath, allowed to drip and rinsed five times with water having ambient temperature.

EXAMPLE 1

A household wash cycle is carried out with the following temperature and aqueous prewash bath conditions:

temperature: 60° C.

hydrogen peroxide, $H_2O_2$: 0.034% barium: 0.137%, introduced in the form of $Ba(OH)_2$.

The bath does not contain any agent complexing barium ions.

The bleaching effect observed after washing at 60° C. in a bath consisting of water and 0.67% detergent is 30.5% in the case of tea and 53% in that of wine.

If Example No. 1 is repeated in the absence of barium but in the presence of sodium hydroxide taken in a quantity permitting the same pH conditions to be maintained in the course of the prewash, the bleaching effect is only 26.5% in the case of tea and 49.5% in that of wine.

EXAMPLE 2

A household wash cycle is carried out with a prewash conducted under the following temperature and aqueous alkaline bath composition conditions:

temperature: 60° C., detergent: 0.47%, tetrahydric sodium perborate: 0.10%, sodium hydroxide, NaOH: 0.076%, barium in noncomplexed form: 0.13%, introduced in the form of $BaCl_2$.

The rest of the cycle is carried out as in the above examples.

The bleaching effect determined at the end of the cycle is 24.0% in the case of tea and 49% in that of wine.

In the same conditions as above, but in the absence of barium, the bleaching effect is only 20.5% for tea and 31% for wine.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A process for bleaching domestic laundry in a household wash cycle, comprising prewashing the laundry in an alkaline bath with a pH value between 9 and 13 and at a temperature between about 40° C. and 70° C. in the presence of an uncomplexed barium, an agent which complexes alkaline-earth metal up to an amount such that the quantity of uncomplexed barium in the bath is maintained, and a bleaching composition consisting of at least one peroxide bleaching agent, said barium being present in an amount between about $0.5\times10^{-3}$ and $250\times10^{-3}$ grams-atoms per kg of bath.

2. The process of claim 1, wherein said uncomplexed barium is barium oxide or barium hydroxide.

3. The process of claim 1, wherein said uncomplexed barium is a barium salt whose anion is inert with respect to the peroxide bleaching agent, and whose dissociation constant is higher than 0.01.

4. The process of claim 3, wherein said barium salt is barium chloride.

5. The process of claims 1, 2, 3, or 4, wherein the quantity of barium in the prewash bath is between about $1.25\times10^{-3}$ to $25\times10^{-3}$ gram-atoms per kg bath.

6. The process of claims 1, 2, 3, or 4, wherein the prewash bath contains agents which complex alkaline-earth metals.

7. The process of claims 1, 2, 3, or 4, wherein the prewash bath is made alkaline by the addition of sodium hydroxide in an amount to adjust the pH value of the bath between 9 and 13.

8. The process of claim 1, 2, 3, or 4, wherein the pH of the prewash bath is between 10.5 and 12.5.

9. The process of claims 1, 2, 3, or 4, wherein the peroxide bleaching agent is selected from hydrogen peroxide, sodium perborate, sodium percarbonate, urea peroxyhydrate, or mixtures thereof.

* * * * *